United States Patent [19]

Weber et al.

[11] 4,281,599

[45] Aug. 4, 1981

[54] PROJECTILE

[75] Inventors: Adolf Weber, Neunkirchen; Siegfried Rhau, Nuremberg, both of Fed. Rep. of Germany

[73] Assignee: Diehl GmbH & Co., Fed. Rep. of Germany

[21] Appl. No.: 43,134

[22] Filed: May 29, 1979

[30] Foreign Application Priority Data

Jun. 6, 1978 [DE] Fed. Rep. of Germany ..... 2824738

[51] Int. Cl.[3] ..... F42B 11/14

[52] U.S. Cl. ..... 102/364; 102/518

[58] Field of Search ..... 102/6, 66, 90, 52, 92.1–92.7

[56] References Cited

U.S. PATENT DOCUMENTS

| | | | |
|---|---|---|---|
| 2,435,095 | 1/1948 | Nichols | 102/52 |
| 2,801,590 | 8/1957 | Balke et al. | 102/66 |

FOREIGN PATENT DOCUMENTS

| | | | |
|---|---|---|---|
| 1578115 | 4/1971 | Fed. Rep. of Germany | 102/52 |

*Primary Examiner*—Harold J. Tudor

*Attorney, Agent, or Firm*—Scully, Scott, Murphy & Presser

[57] ABSTRACT

A projectile including a penetrating member and a pyrotechnic composition, such as an incendiary composition. The composition is located ahead of the head portion of the penetrating member and is surrounded by a ballistic hood. The projectile includes a solid insert of a pyrophorically acting metal or an alloy containing such a metal. In order to increase the effect of the projectile, the pyrometal insert is located in a recess provided in the head portion of the penetrating member. Furthermore, arranged in a rearward extension of the recess and immediately behind the pyrometal insert is, additionally, an explosive material insert adapted to be detonated at impact against a target.

5 Claims, 1 Drawing Figure

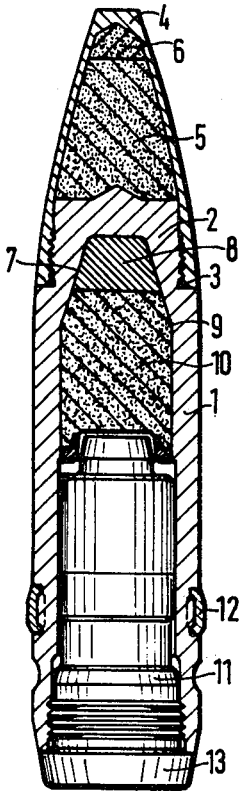
4
6
5
2
8
7
3
9
10
1
12
11
13

PROJECTILE

BACKGROUND OF THE INVENTION

1. Field of the Invention

The present invention relates to the projectile including a penetrating member and a pyrotechnic composition encompassed by a ballistic hood which is arranged ahead of the head portion of the penetrating or piercing member, preferably an incendiary composition, as well as a solid insert from a pyrophorically acting metal, for instance, an alloy containing such a metal.

2. Discussion of the Prior Art

A projectile of this type is known from German Laid-open Patent Application No. 23 46 141 wherein, through the employment of a solid ogive-shaped insert of a zirconium sponge, which is arranged ahead of the penetrating member below the ballistic hood, at target impact there can be achieved an intense incendiary effect ahead of as well as rearwardly of the pierced target surface.

Particularly in the combating of relatively weakly armored targets having a multiple bulkheaded or compartmented construction, such as aircraft, in addition to an intensive incendiary effect, sought after is also a large as possible shell splintering effect. For this reason it is already known (German Laid-open Patent Application No. 25 52 950), that in a projectile with a penetrating member, there be provided ahead thereof, beneath a ballistic hood, a pyrotechnic composition, preferably constituted of an incendiary composition, as well as a further pyrotechnic composition within the penetrating member, in this instance a mixture formed of an explosive and incendiary composition. At impact against a target, in this known projectile there is initially ignited the incendiary composition which is arranged ahead of the penetrating member and which covers the target surface with fire. Thereafter activated is the pyrotechnic composition which is located in the penetrating member. Consequently, the penetrating member is disintegrated into splinters which penetrate into the interior of the target whereby, depending upon circumstances, portions of the incendiary composition is pulled along and will thus also create an incendiary effect interiorly of the target.

Hereby, primarily when the penetrating member incorporates a preset rupturing location, the fragments into which this member is disintegrated can still be relatively large and, in particular, the head portion of the penetrating member can be propelled away in a single piece. However, just in the combating of flying targets it is desired to have a large number of splinters so as to increase the probability of damaging important operational components of the aircraft (hydraulic system, fuel conduits).

SUMMARY OF THE INVENTION

Accordingly, it is an object of the present invention to so improve the effect of a projectile of the above mentioned type whereby the penetrating member is disintegrated into the largest possible number of splinters.

The present invention attains this object in that, in a projectile of that type, it provides for an insert of pyrometal being arranged in a recess or hollow in the head portion of the penetrating member and that, in a rearward extension of this recess there is additionally arranged behind the insert of pyrometal an insert of an explosive which is detonatable upon impact against a target.

In this manner there is achieved that the insert of pyrometal not only assists towards intensive incendiary effect but, due to its mass moment of inertia at target impact, concurrently serves for a disintegration of the head portion of the penetrating member into the smallest possible fragments. These, together with the hereby also fragmented pyrometal insert are propelled far into the interior of the target object through the detonation of the explosive arranged behind this insert and which is detonatable upon impact against the target.

Due to the fact that the head of the penetrating member in the inventive projectile is partially replaced by the insert of pyrophorically acting metal, the head portion can be retained relatively thin-walled without the penetrating member hereby sacrificing a portion of its mass and, as a consequence, its penetrability. The thus reduced wall thickness facilitates hereby a disintegration of the head portion at target impact into relatively small splinters.

A further advantage is obtained by the projectile pursuant to the invention from the arrangement of the pyrometal insert in the interior of the penetrating member whereby the fragments of this insert, additionally accelerated by the explosive, can penetrate particularly far into the interior of the target object. The effective range of the detonation effect is thus considerably increased.

In an advantageous embodiment of the inventive projectile it is contemplated to provide the insert of pyrometal with the form of a plug and the recess is constructed so as to reduce in the direction towards the projectile tip. Through this special construction of insert and shell housing, the sought after most complete disintegration of the penetrating member is further enhanced and assured even under the most unsatisfactory impact conditions. Inasmuch as in the preferred embodiment of the inventive projectile the recess in the penetrating member which receives the two inserts additionally contains a base detonator which closes this recess towards the rear, there is effected a predefined detonation of the explosive insert at its rear end. Produced thereby is a progressive detonation front advancing in a direction towards the projectile tip, which provides the result of a strong forward orientation of the splinters of the penetrating member as well as those of the pyrometal insert, and thus still further improves the effectiveness of the projectile.

Found to be particularly suited for the heavy metal insert has been zirconium with regard to its pyrophoric effect, as well as for the sought after function of the inventive projectile during the disintegration of the penetrating member.

BRIEF DESCRIPTION OF THE DRAWING

The invention is now described in connection with an exemplary embodiment of a projectile, taken in conjunction with the drawing, in which the single FIGURE illustrates a longitudinal section through a projectile constructed pursuant to the invention.

DETAILED DESCRIPTION

The projectile includes a penetrating or piercing member 1 which is formed as a hollow body, whose head portion 2 is separated from the rear portion by means of a predetermined rupturing location 3 formed as an annular groove. This concurrently serves as a fastening groove for a ballistic projectile hood 4 which encompasses a pyrotechnic composition 5 which consists of an incendiary compound with an igniter charge. Located in a recess 7 which is provided in the head portion 2 of the penetrating member 1, and which conically reduces in the direction towards the projectile tip, there is arranged a solid insert 8 in the form of a plug. This insert consists of a pyrophorically acting metal, such as zirconium, titanium, cerium, or of an alloy containing such a metal.

In a rearward extension 9 of the recess 7, arranged immediately behind the pyrometal insert 8 is a further insert 10 which is constituted of an explosive. The spearating point between the pyrometal insert 8 and the explosive 10 is hereby arranged at the elevation of the rupturing location 3. The explosive insert 10 can be detonated at target impact through the intermediary of a base detonator 11 which rearwardly closes off the recess 7, 9 of the penetrating member 1. The projectile is provided with a guide ring 12 and closed rearwardly by means of a base screw 13 which is a portion of the base detonator 11.

When this projectile hits against an armored or multiple bulkheaded or compartmented target, initially destroyed is the ballistic hood 4 and the pyrotechnic composition 5 is ignited through the igniter charge whereby, initially, the surface of the target is covered with fire.

At the subsequent impacting of the penetrating member 1 against the target, the former is disintegrated into a larger number of splinters under the effect of the plugshaped pyrometal insert 8. These splinters, due to their mass movement of inertia and the propagated detonation front of the explosive material insert 10 which is detonated by the base detonator 11, together with the fragments of the similarly disintegrated pyrometal insert 8, are propelled far into the interior of the target and will occasion therein a splintering as well as an intensive incendiary effect.

We claim:

1. An incendiary projectile including a penetrating member (1) formed as a hollow projectile having therein an explosive charge (10) ignitable through a base detonator (11), and a pyrotechnic incendiary composition (5) encompassed by a ballistic hood, (4), characterized in that the head portion (2) of the penetrating projectile is reinforced by a solid pyrometal insert (8), and the head portion (2) is separable from the rear portion of the penetrating projectile along a predetermined rupturing location (3) located intermediate the pyrometal insert (8) and the explosive charge (10).

2. Projectile as claimed in claim 1 said pyrometal metal insert comprising an alloy containing said material.

3. Projectile as claimed in claim 1, said pyrometal insert being substantially plugshaped, a recess being formed in the head portion of said penetrating member, said pyrometal insert being arranged in said recess, said recess also having a reducing cross-section in the direction towards the tip of said projectile.

4. Projectile as claimed in claim 1, said base detonator being arranged in said recess in the penetrating member adapted to be detonated at target impact, said base detonator rearwardly closing off said recess.

5. Projectile as claimed in claim 1, said pyrometal being selected from the group consisting of zirconium, titanium and cerium or from alloys containing said metals.

* * * * *